US006302644B1

(12) United States Patent
Kukalj et al.

(10) Patent No.: US 6,302,644 B1
(45) Date of Patent: Oct. 16, 2001

(54) STEAM TURBINE

(75) Inventors: Ivan Kukalj, Baden; Franz Suter, Gebenstorf, both of (CH)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/495,480

(22) Filed: Feb. 1, 2000

(30) Foreign Application Priority Data

Feb. 4, 1999 (EP) ..... 99810092

(51) Int. Cl.[7] ..... F01D 17/14

(52) U.S. Cl. ..... 415/155; 415/150; 415/157; 415/159; 415/202; 415/915

(58) Field of Search ..... 415/108, 150, 415/151, 155, 157, 159, 202, 912, 915

(56) References Cited

U.S. PATENT DOCUMENTS 3,190,612 * 6/1965 Conrad, Sr. et al. ..... 415/151
3,350,061 * 10/1967 Strass ..... 415/155
4,642,025 2/1987 Heiniger et al. .
5,695,317 12/1997 Ritter .

FOREIGN PATENT DOCUMENTS 852 247 8/1952 (DE) .
44 25 352 1/1996 (DE) .
44 25 353 1/1996 (DE) .
478810 1/1938 (GB) .
63-38605-A * 2/1988 (JP) ..... 415/202

* cited by examiner

*Primary Examiner*—Christopher Verdier
(74) *Attorney, Agent, or Firm*—Burns, Doane, Swecker & Mathis, L.L.P.

(57) ABSTRACT

Steam turbines with or without a control stage are constructed with the same number of control valves. There are preferably two control valves in each case. The valve subassembly, the turbine outer casing and parts of the turbine inner casing are of identical design and can be used for steam turbines with or without a control stage. In the case of the steam turbine illustrated with a control stage, the inner casing is provided with integrated nozzle boxes, which are separated from each other by intermediate walls. In the case of a steam turbine without a control stage, the nozzle boxes, and accordingly, also the intermediate walls are missing.

7 Claims, 5 Drawing Sheets

STEAM TURBINE

FIELD OF THE INVENTION

The invention relates to a steam turbine with regulation of the fresh steam flow.

BACKGROUND OF THE INVENTION

Steam turbines with nozzle section regulation, in which the first turbine stage, also called the control stage, of the steam turbine is equipped with a plurality of admission sectors, whose steam flow can be set by a specific control valve in each case are known. In such steam turbines, there are in each case at least three or more control valves.

Steam turbines without nozzle section regulation or without a control stage are also known. Such steam turbines are constructed with at least one control valve up to 180 MW, with two control valves up to 600 MW and with four control valves over 600 MW.

The turbine casings of steam turbines with a control stage are constructed differently in design terms than the turbine casings of steam turbines without a control stage.

SUMMARY OF THE INVENTION

The invention is based on the object of achieving a reduction in the casting models and the modules, especially for the turbine casings, and as a result achieving lower refitting times and lower costs.

According to the invention, this is achieved in that the number of control valves for regulating the fresh steam flow on a steam turbine with a control stage is identical to that for one without a control stage, there being at least two control valves, and in that the turbine outer casing of a steam turbine with a control stage is of identical design, at least in the region of the fresh steam inlet section, to one without a control stage.

BRIEF DESCRIPTION OF THE DRAWINGS

Exemplary embodiments of the steam turbine according to the invention are illustrated in simplified form in the drawings, in which.

DETAILED DESCRIPTION OF THE PREFERRED EMBODIMENTS

Figure 1:
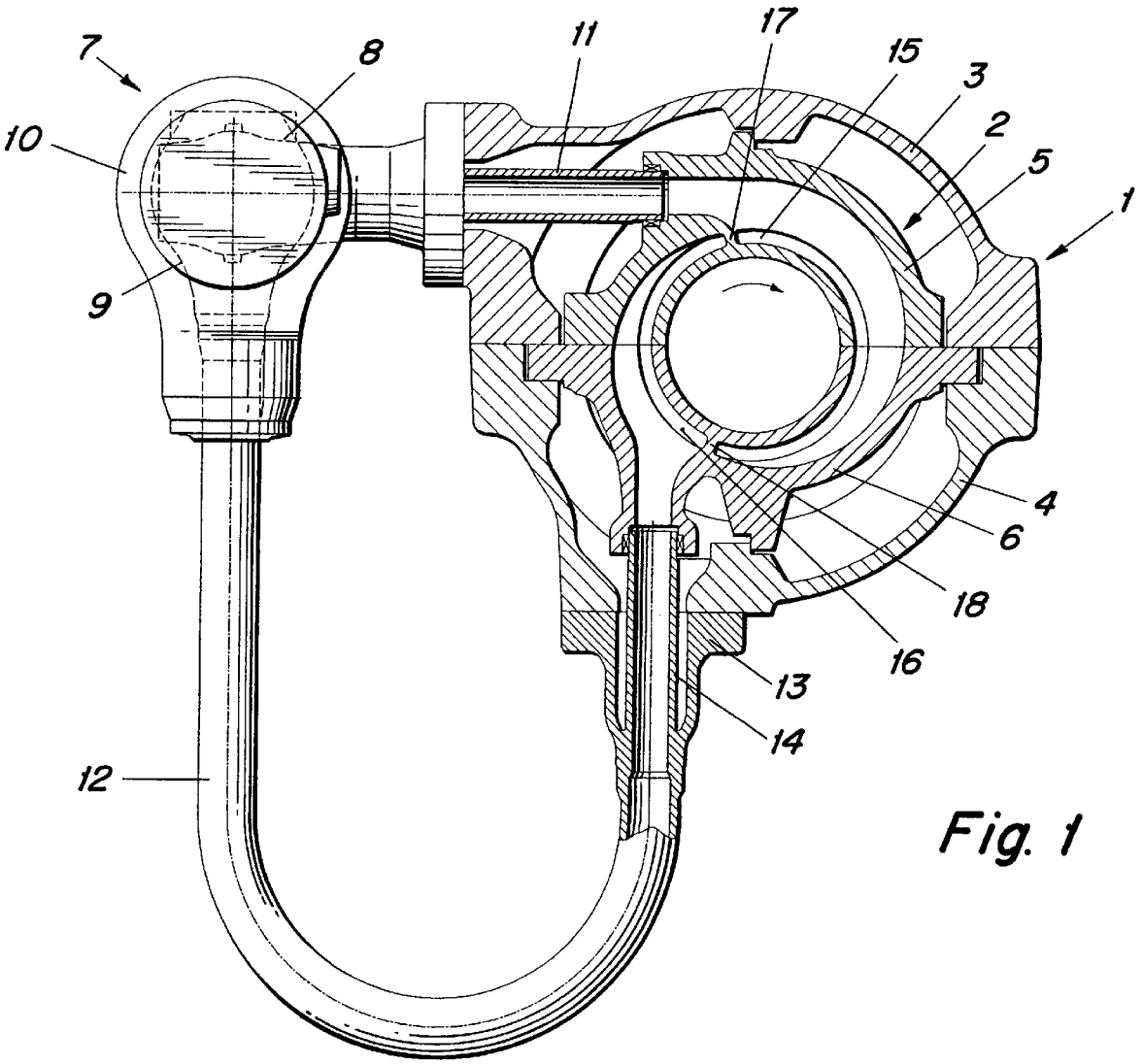
FIG. 1 shows a cross section in the region of the fresh steam flow of a first embodiment of an HP steam turbine with a control stage.
Figure 2:
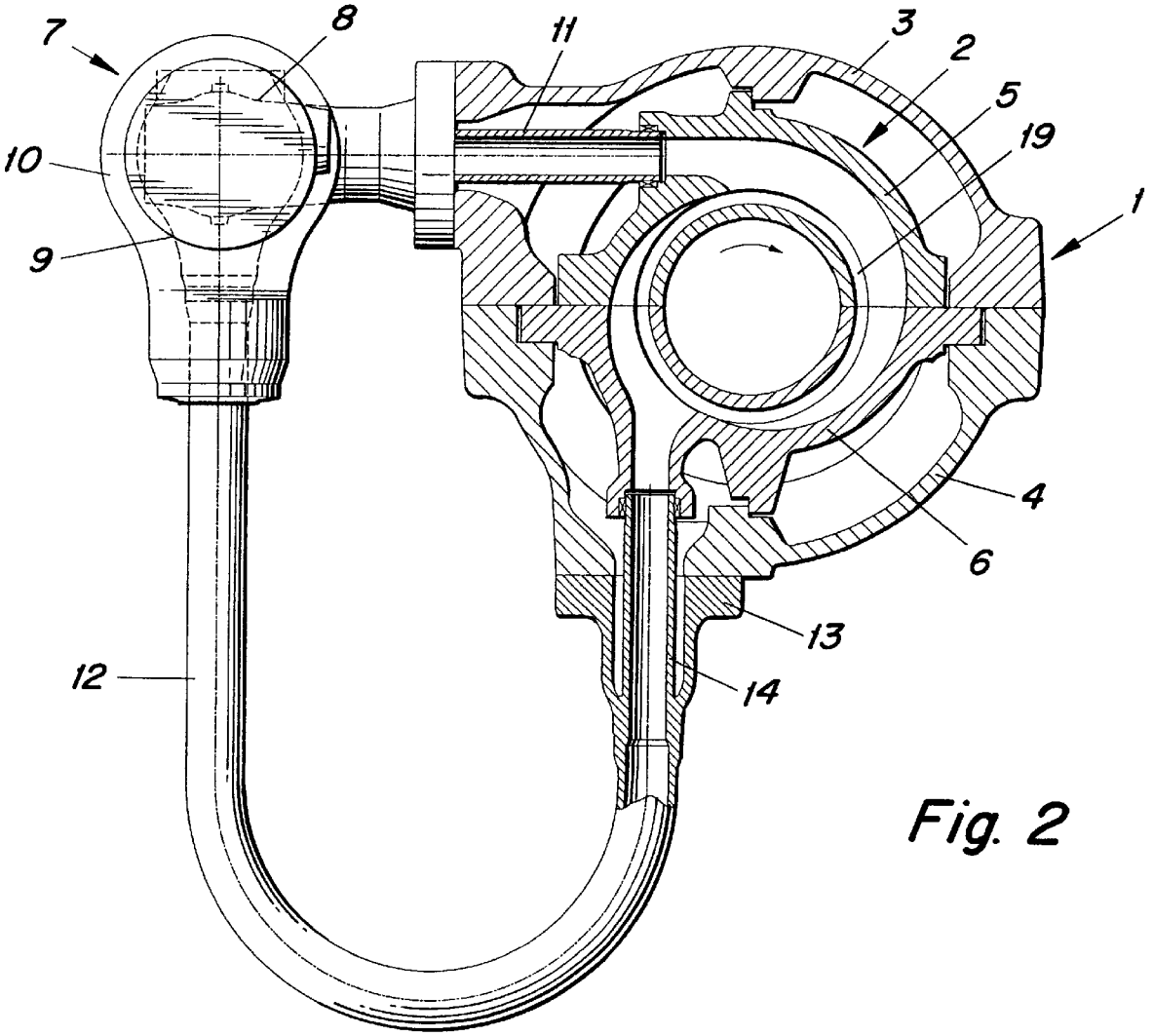
FIG. 2 shows a cross section in the region of the fresh steam flow of the embodiment of an HP steam turbine according to FIG. 1 without a control stage.

The high-pressure steam turbines illustrated in FIGS. 1 and 2 comprise two casings, the outer casing 1 and the inner casing 2. The turbine rotor is not illustrated. The outer casing 1 in each case comprises an upper casing part 3 and a lower casing part 4, which are connected to each other by a horizontal flange joint. The inner casing, which is mounted in the outer casing, is likewise divided horizontally and has an upper casing part 5 and a lower casing part 6.

In the steam turbines illustrated in FIGS. 1 and 2, two control valves 8, 9 and an emergency shut-off valve 10 are combined in a valve housing block 7. The valve housing block is fitted to the side of the upper outer casing part 3, over the housing of the control valve 8, by means of a flanged joint. A connecting pipe 11 which is connected to the outlet of the control valve 8 extends into the upper part of the outer casing and opens laterally at the top into the interior of the inner casing 2. The outlet of the control valve 9 is connected to one leg of a connecting line 12 which is lead downwards and bent in a U shape and whose other leg is welded onto an intermediate piece 13 which is flange-mounted on the lower outer casing part 4. The connecting line 12 opens into a connecting pipe 14 which is connected to the intermediate piece 13. The connecting pipe 14 extends into the lower casing part 4 of the outer casing and opens at the bottom into the interior of the inner casing 2.

The emergency shut-off valve 10 has the task of interrupting the steam feed to the control valves 8 and 9, and therefore to the turbine, in the event of an emergency shut-off. It is conceived as a safety element and is operated by a servo motor (not illustrated).

The two control valves 8 and 9 are used to regulate the steam flow. They are operated by hydraulic actuators (not illustrated).

The steam turbines according to FIGS. 1 and 2 differ in the fact that the steam turbine according to. FIG. 1 has a control stage and the steam turbine according to FIG. 2 is designed without a control stage. In both cases, the same valve housing block 7 is present, and is also flange-mounted in the same way to the turbine outer casing. By virtue, in particular, of the fact that there is the same number of control valves for both designs, that is to say the design with a control stage and the design without a control stage, and their connection arrangement and connection in relation to the outer casing 1 and the inner casing 2 are configured identically, a reduction in casting models and a reduction in modules is achieved. This makes it possible, in particular, to design the outer casing 1 and also the valve housing block with the connections identically for both designs of a steam turbine.

The only difference between the two designs is one part of the inner casing.

In the steam turbine with a control stage according to FIG. 1, the inlet ducts and nozzle boxes 15, 16 are integrated in the inner casing 2. The control wheel connected downstream of the nozzle boxes 15, 16 in the direction of flow of the steam is not illustrated.

The inlet ducts and nozzle boxes 15, 16 are separated from one another by two intermediate walls 17, 18 in such a way that the nozzle box 15 forms a larger sector, and therefore a larger passage area for the fresh steam, than the nozzle box 16. Control valve 8 opens into the nozzle box 15 from above, and control valve 9 opens into the nozzle box 16 from below.

Using two actuating valves with two downstream nozzle segments of different sizes, as illustrated in FIG. 1, it is possible to operate the turbine at three optimum load points.

The two control valves can be provided with passage openings of different sizes matched to the nozzle segments. Each control valve can be operated independently in the opening and closing directions.

The fresh steam -is fed to the valve housing block 7, flows through the emergency shut-off valve 10 and passes to the control valves 8, 9 arranged in series. After the control valves 8, 9 the steam is fed to the nozzle boxes 15, 16 and to the nozzles (not illustrated) of the control stage.

In the steam turbine without a control stage according to FIG. 2, the inner casing does not have a nozzle box, nor is there any control wheel. Accordingly, there are no intermediate walls 17, 18 in the inlet section of the inner casing 2 either, so that a single annular space 19 is formed, to which the fresh steam is fed via the two control valves 8, 9. Otherwise, the components of the steam, turbine without a control stage according to FIG. 2 correspond to the components illustrated in FIG. 1 of the steam turbine with a control stage. Accordingly, the same components have the same reference numbers and, in this respect, reference is made to the above description.

Figure 3:
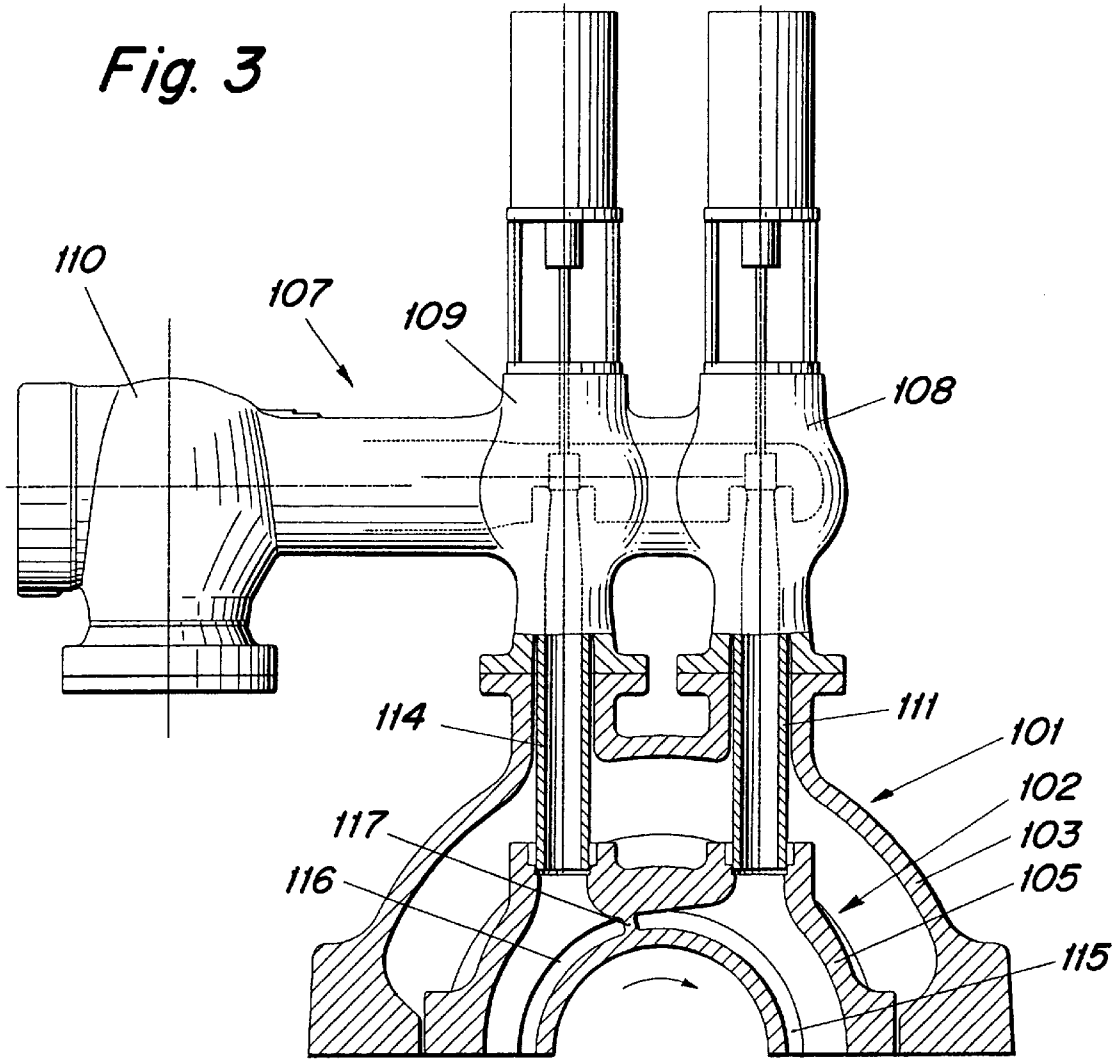
FIG. 3 shows a cross section in the region of the fresh steam flow of a second embodiment of an HP steam turbine with a control stage.
Figure 4:
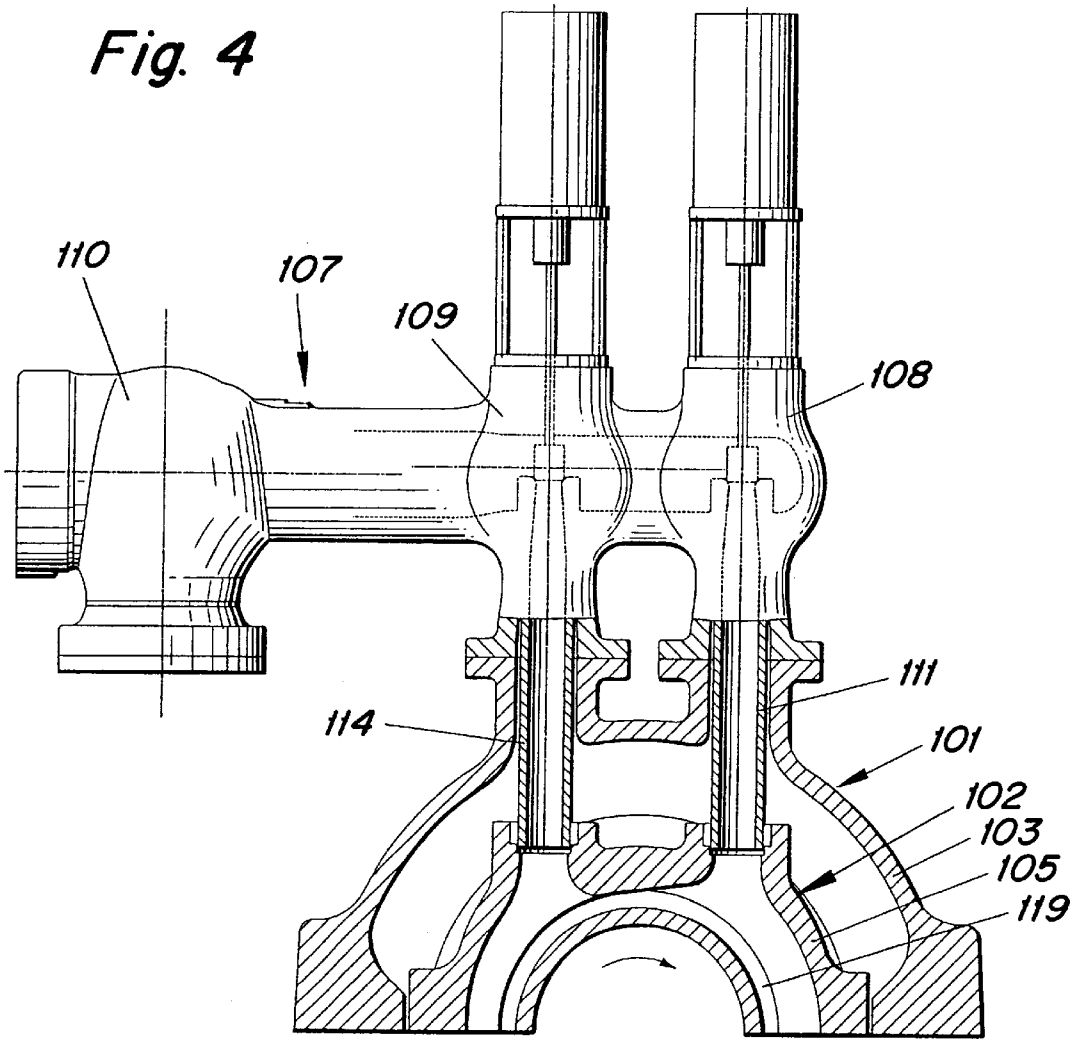
FIG. 4 shows a cross section in the region of the fresh steam flow of the embodiment of an HP steam turbine according to FIG. 3 without a control stage.

The high-pressure steam turbines illustrated in FIGS. 3 and 4 differ in the manner of construction and connection of the valve housing block. Otherwise, the steam turbines illustrated in FIGS. 3 and 4 also comprise two casings, the outer casing 101 and the inner casing 102. The outer casing in each case comprises an upper casing part 103 and a lower casing part (not illustrated), which are connected to each other by a flange joint (not illustrated). The inner casing, mounted in the outer casing, is likewise divided horizontally and has an upper casing part 105.

The lower inner casing part is likewise not illustrated.

The steam turbines according to FIGS. 3 and 4 each have a valve housing block 107, in which two control valves 108, 109 and an emergency shut-off valve 110 are incorporated. The valve housing block 107 is placed on the outer casing upper part 103 and connected to the latter by means of a double flange joint. In each case a connecting pipe 111, 114 which is connected to the outlets of the control valves 108, 109 extends into the upper part 101 of the outer casing and opens from above into the interior of the inner casing 102.

The task and function of the emergency shut-off valve 110 and of the control valves 108, 109 is the same as in the steam turbines according to FIGS. 1 and 2. The differences and common features of the steam turbines according to FIGS. 3 and 4 are likewise the same as those relating to the steam turbines according to FIGS. 1 and 2. In this regard, therefore, reference is made to the above explanations.

Once again, in the two designs of steam turbines with a control stage according to FIG. 3 and without a control stage according to FIG. 4, the only difference is one part of the inner casing, necessitated by the presence or absence of the control stage. In the steam turbine with a control stage according to FIG. 1, the nozzle boxes 115, 116 integrated in the inner casing 102 are again separated from each other by intermediate walls, of which only the intermediate wall 117 located in the upper inner casing part is illustrated, the separation being such that one nozzle box forms a larger sector and therefore a larger passage area for the fresh steam than the other nozzle box. The same is also true here of the load points and the design and mode of action of the control valves and the fresh steam feed as in the explanations already given in relation to FIG. 1.

In the steam turbine without a control stage according to FIG. 4, the explanation given further above in relation to the embodiment according to FIG. 2 applies. The nozzle boxes and the control wheel are missing and, accordingly, so are the intermediate walls, so that once more there is a single angular space 119, to which the fresh steam is fed via the two control valves 108, 109.

In the embodiments according to the invention, the turbine outer casing, the valve subassembly and parts of the inner casing can be used for steam turbines of a specific type either with or without a control stage, since they are executed identically in design terms and correspond in size and shape.

The actuating valves of the valve subassembly generally have passage openings of equal size. In special cases, however, they can also have passage openings of different sizes.

The same casting model can be used for the production of at least the outer casings from cast steel for a steam turbine of a specific type either with or without a control stage.

The same casting model can be used for the outer casing for turbines either with or without a control stage.

The same valves and valve dispositions (arrangements) can be used for turbines either with or without a control stage.

Therefore, only one casting model, comprising an upper part and lower part, is necessary for the production of the outer casings of the steam turbines according to FIGS. 1 and 2. The same applies to the steam turbines according to FIGS. 3 and 4.

Figure 5:
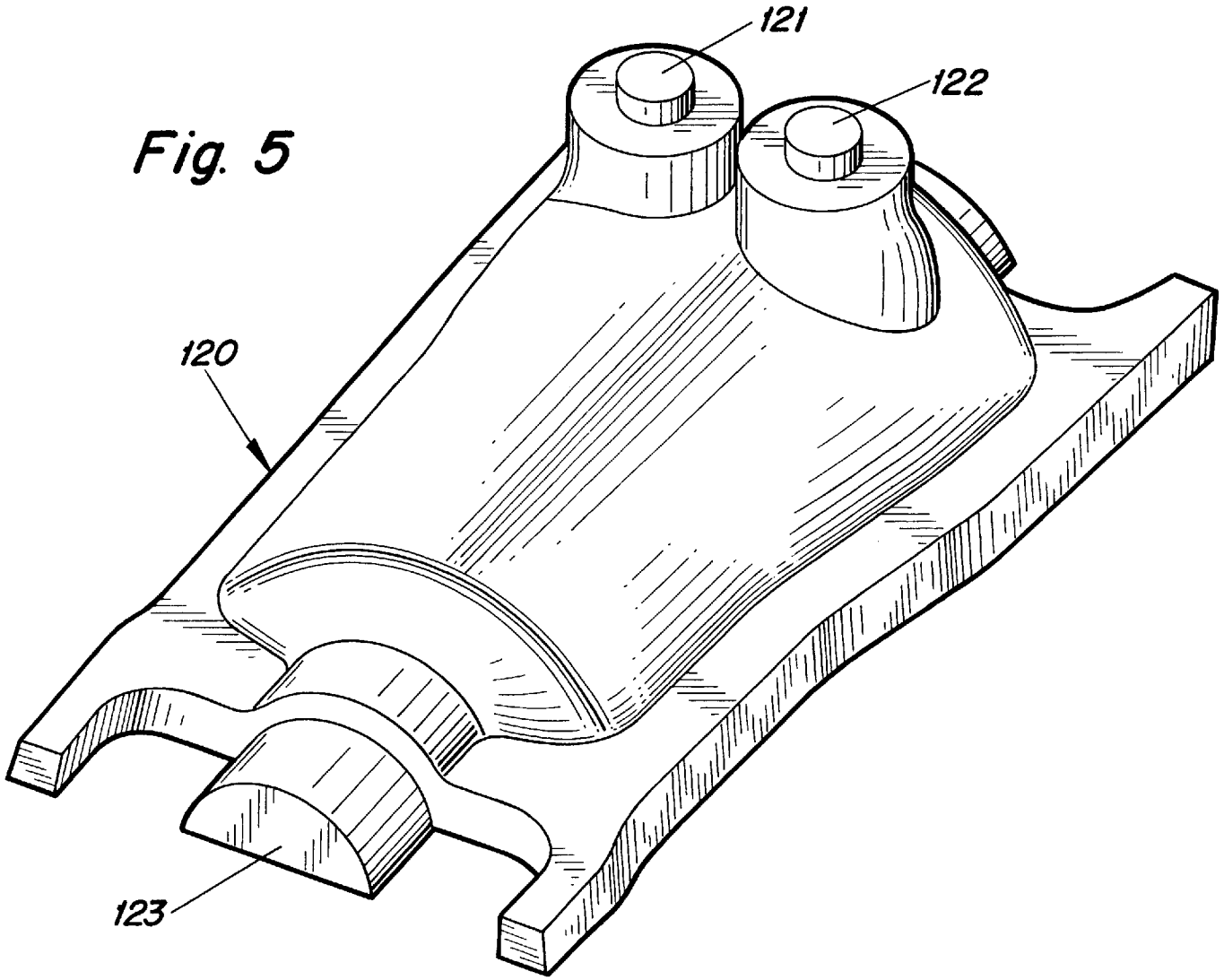
FIG. 5 shows a diagrammatic view of the casting model of the upper casing part of the outer casing of a steam turbine according to FIGS. 3 and 4.

FIG. 5 shows the upper part of a casting model 120 from above, with cores 121, 122 and 123 inserted, this model being used for the production of the upper outer casing part of a steam turbine according to FIG. 3 or FIG. 4.

What is claimed is:

1. A steam turbine comprising:

at least two control valves;

a turbine outer casing having a fresh steam inlet section; and an inner casing in fluid connection with said outer turbine casing, said inner casing is formed without a control stage or nozzle section regulation;

wherein the turbine outer casing of said steam turbine is of substantially identical design, at least in the region of the fresh steam inlet section, to a steam turbine having a control stage.

2. The steam turbine as claimed in claim 1, wherein there are two control valves.

3. The steam turbine as claimed in claim 1, wherein the control valves are arranged in a valve housing block, and the valve housing block is of substantially identical design to a valve housing block of the steam turbine having a control stage.

4. The steam turbine as claimed in claim 1, wherein all the control valves have passage openings of equal size.

5. The steam turbine as claimed in claim 1, further comprising admission sectors having nozzle areas, wherein in said steam turbine having a control stage, the nozzle areas of the admission sectors are of different sizes.

6. A method of producing a turbine outer casing of a steam turbine without a control stage, comprising the steps of:

using a casting model to produce a fresh steam inlet section of the turbine outer casing, wherein the casting model is of substantially identical design to a steam turbine having a control stage.

7. A casting model for producing an outer casing of a steam turbine without a control stage, wherein said casting model is substantially identical in shape and size to a steam turbine having a control stage.

* * * * *